United States Patent [19]

Watson

[11] 4,151,378

[45] Apr. 24, 1979

[54] ELECTROSTATIC MICROPHONE WITH DAMPING TO IMPROVE OMNIDIRECTIONALITY, FLATTEN FREQUENCY RESPONSE, REDUCE WIND NOISE

[75] Inventor: Alan R. Watson, Niles, Mich.

[73] Assignee: Electro-Voice, Incorporated, Buchanan, Mich.

[21] Appl. No.: 903,809

[22] Filed: May 8, 1978

[51] Int. Cl.[2] ..... H04R 1/20; H04R 19/04

[52] U.S. Cl. ..... 179/111 R; 179/179; 179/180

[58] Field of Search ..... 179/111 R, 111 E, 121 R, 179/179, 180, 184

*Primary Examiner*—George G. Stellar

*Attorney, Agent, or Firm*—Burmeister, York, Palmatier, Hamby & Jones

[57] ABSTRACT

An electret microphone in which the condenser unit of the microphone is contained within a cylindrical shell open at one end and mounted coaxially on a larger cylindrical casing at the other, the region surrounding the shell and extending to the casing having a mass of closed cellular plastic foam therein, and the open end of the casing being covered by a layer of open cellular foam plastic, the mass of closed cellular foam plastic and layer of open cellular foam plastic being contained within a wire grill.

7 Claims, 3 Drawing Figures

ELECTROSTATIC MICROPHONE WITH DAMPING TO IMPROVE OMNIDIRECTIONALITY, FLATTEN FREQUENCY RESPONSE, REDUCE WIND NOISE

The present invention relates to condenser microphones, and more particularly to omnidirectional electret microphones.

According to *Acoustical Engineering* by Harry F. Olson, D Van Nostrand Company, Inc., N.J., 1957, condenser microphones were developed in the mid 1920's and employed for sound reproduction. Thereafter, condenser microphones were replaced by other types of microphones until the 1950's. More recently, condenser microphones have been materially improved as a result of the development of the electret condenser unit, which eliminated the need for a power source and made it more convenient to construct microphones in smaller diameters. U.S. Pat. No. 3,944,756 to Thomas C. Lininger entitled ELECTRET MICROPHONE is an example of such a microphone.

Condenser microphones, whether of the electret or conventional type, employ a diaphragm constructed of metal or metal coated plastic film which is stretched across an opening in the housing of the microphone and spaced from a metal back plate or electrode. As pointed out in *Microphones: Design and Application* by Lou Burroughs, Sagamore Publishing Company, Inc., 1974, the exact tension on the diaphragm is very important to the operation of the microphones, and the spacing of the diaphragm from the back plate or electrode controls the sensitivity of the microphone. The diaphragm carries a polarizing voltage with respect to the back plate or electrode.

One of the design difficulties in a condenser or electret microphone is that the output of the microphone rises at the high frequency end of the response range of the microphone. In the example given of a condenser microphone at page 256 of the Olson reference, the fundamental resonant frequency of the diaphragm is stated to be about 9,000 cycles, hence tending to produce increased output at the higher end of the frequency response range of the microphone. It is one of the objects of the present invention to provide a condenser microphone, and particularly an electret microphone, in which the response range remains relatively flat throughout the response range.

Microphones tend to be responsive to air passing over the diaphragm and produce a sound known as wind noise. It is also an object to provide a condenser microphone, particularly an electret microphone, with reduced suspectibility to wind noise.

It is also an object of the present invention to provide an omnidirectional microphone in which the omnidirectional characteristics of the microphone extend to the upper limit of the frequency response range. As pointed out on page 20 of the Burroughs text, omnidirectional microphones become directional at the higher frequencies if the baffle diameter of the microphone exceeds one-half inch. An example of the deficiency in the polar response pattern of an omnidirectional microphone with a three-quarter inch diameter is given at page 21 of the Burroughs book. However, convenience generally requires the use of a handle of significant size to fit the hand of the user, and to contain a preamplifier for the microphone. The microphone industry has virtually standardized a handle for hand held use of 0.75 inch in diameter and a larger head portion, usually with a cross section in excess of one inch. Such a handle will adversely affect the omnidirectional response of a microphone at the higher frequencies of the response range, even if the transducer unit is mounted to protrude from the handle. In order to improve the omnidirectional properties of microphones designed to be used as standards in laboratory and experimental work, small transducers have been mounted at the end of a long tube of very small diameter which extends from the handle of the microphone. Such constructions are not considered satisfactory for a practical microphone because of their delicacy, excessive length and awkwardness.

In accordance with the present invention, an omnidirectional microphone with an improved polar pattern is achieved by employing a transducer unit with a cross section no greater than three-fourths of the length of a wavelength of sound at the highest frequency of the response range of the microphone mounted on and protruding from a handle of larger cross section, and employing a mass of closed cellular foam material about the transducer unit, the mass extending to the handle, which is a distance at least three-fourths of the diameter of the transducer. A more uniform output throughout the frequency response range of the microphone is also attained by providing the microphone with a relatively high frequency mechanical diaphragm resonance and heavily damping the diaphragm by means of acoustical resistance disposed on the side of the diaphragm opposite the back plate or electrode. This construction has the further advantage of materially reducing wind noise.

The objects of the present invention and the invention itself will be more fully understood from the following embodiment of the invention which is illustrated in the drawings in which.

Figure 1:
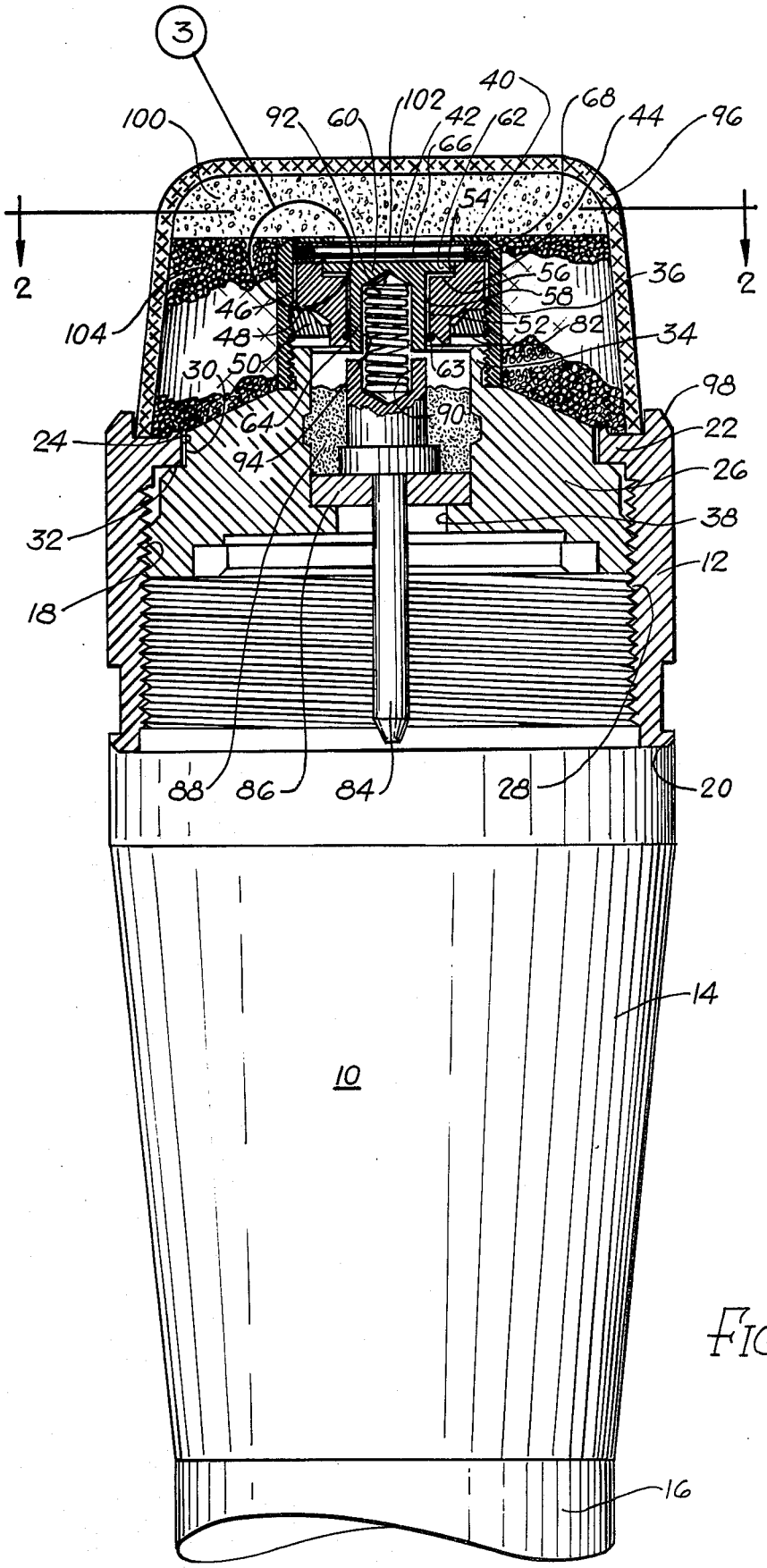
FIG. 1 is a vertical sectional view of a microphone constructed according to the teachings of the present invention.

An omnidirectional microphone must produce the same electrical output from a sound wave of a given amplitude whether the sound wave originates behind the microphone or in front of the microphone. The microphone, however, must have a casing of sufficient size to be comfortable when held in the hand of the user or mounted for use, and FIG. 1 illustrates a casing 10 of suitable dimensions for the convenience of the user. The casing 10 has a head portion 12, a tapering center portion 14, and a cylindrical handle portion 16, which is fragmentarily illustrated. The diameter of the handle portion 16 has been made approximately ¾ inch for the convenience of the user, and the diameter of the cylindrically shaped head portion 12 of the casing is approximately one inch.

The head portion 12 is provided with a cylindrical threaded inner surface 18 which extends from an open end 20 to an inwardly extending shoulder 22 at the opposite or front end of the head portion 12. The inner surface of the shoulder 22 forms a cylindrical opening 24.

A ring 26 has an exterior threaded surface 28 which engages the interior threads on the surface 18 of the head portion 12 of the casing 10. The ring 26 is also provided with a cylindrical indentation 30 which forms a shoulder 32 which abuts against the shoulder 22 of the head portion 12 to secure the ring 26 in position with respect to the head portion 12. The ring 26 has a cylindrical protuberance 34 which extends coaxially therefrom, and the exterior surface of the protuberance 34 is provided with threads which engage threads on the interior surface of a cylindrical shell 36. An axial channel 38 extends through the ring 26.

Figure 2:
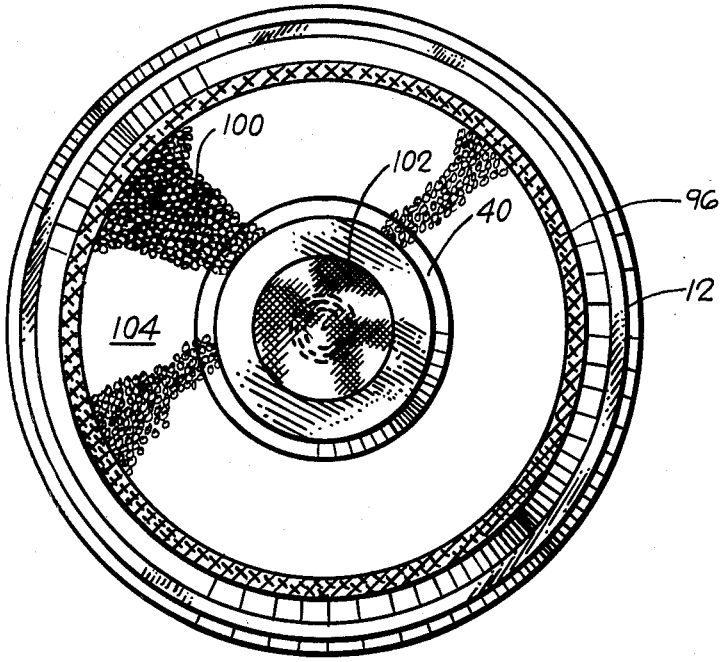
FIG. 2 is a sectional view taken along the line 2—2 of FIG. 1.

The shell 36 has a significantly smaller diameter than the diameter of the head portion 12 of the casing 10, a cross-sectional view thereof is shown in FIG. 2, and if the microphone is to be omnidirectional at the higher frequencies the diameter of the shell 36 must be less than a wavelength at the upper end of the response range of the microphone. In the particular construction, the diameter of the shell 36 is approximately 0.4 inch, and hence the microphone can be omnidirectional to frequencies in the range of 20,000 Hz.

The shell 36 is hollow and is provided with an inwardly extending rim 40 at its end opposite the ring 26, and the inwardly extending rim 40 defines a circular opening 42. An electrode support 44 has a cylindrical outer wall which is translatably disposed within the inner wall of the shell 36, and the electrode support 44 has a flat surface 46 confronting the opening 42. The electrode support 44 also has a rear flat surface 48 opposite the surface 46, and this surface abuts a tensioning ring 50 which has a threaded outer surface which engages the threads on the inner surface of the shell 36.

An axial recess 52 extends into the electrode support 44 from the surface 46, and the recess has a first portion 54 which extends to a shoulder 56. The recess 52 has a second portion 58 which extends from the first portion 54 through the electrode support 44.

An electrode 60 is disposed within the recess 52 of the electrode support 44 with a flat surface 61 (shown in FIG. 3) disposed in the same plane as the surface 46 of the electrode support 44. The surface 61 is on a plate portion 62 of the electrode 60 with a diameter slightly less than the diameter of the first portion 54 of the recess. The electrode 60 also has a second portion 64 with a diameter slightly less than the diameter of the second portion 58 of the recess in the electrode support 44. Further, the region between the first portion 54 of the recess and the second portion 58 of the recess forms a shoulder confronting the plate portion 62 of the electrode, and a significant gap is disposed between this shoulder and the confronting plate portion of the electrode in order to permit the surface 61 to be positioned in the same plane as the surface 46, and a mass of cement 63 between the electrode support 44 and the electrode 60 maintains this relationship.

Figure 3:
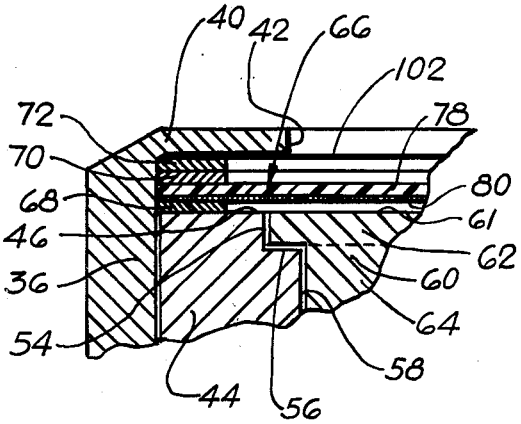
FIG. 3 is a fragmentary view of a portion of the diaphragm illustrated in FIG. 1.

As best illustrated in FIG. 3, a diaphragm 66 is mounted within the shell 36 confronting and spaced from the electrode 60. The diaphragm 66 is mounted in an assembly between a pair of spacer rings 68 and 70. A spacer ring 72 is disposed in abutment with the diaphragm assembly and the inwardly extending rim 40 of the shell 36. The tensioning ring 50, illustrated in FIG. 1, has threads on its outer surface which mate with threads on the inner surface of the shell 36, and the diaphragm assembly is wedged between the spacer ring 72 and the electrode support 44 by tightening the tensioning ring 50 against the electrode support 44.

The diaphragm 66 is a thin film 78 of electrically insulating plastic with a coating 80 of electrically conducting material confronting the electrode 60. In one particular construction, the film 78 is constructed of mylar and the coating 80 is silver. The diaphragm has a diameter less than 0.4 inch and is placed under tension to provide a diaphragm resonance of approximately 12,000 Hz. Due to the small diameter of the diaphragm, a resonance of 12,000 Hz can be achieved within the torsion limits of the diaphragm. The ring 68 is constructed of electrically conducting material, and abuts the electrically conducting shell 36 to electrically connect this layer 80 to the shell. The electrode 60 is constructed of electrically conducting material, such as brass, and it is electrically insulated from the shell by the electrode support 44 which is constructed of electrically insulating material, such as plastic.

As shown in FIG. 1, a terminal pin 84 is mounted within the axial channel 38 which extends through the ring 26 by means of an electrically insulating washer 86 and potting compound 88. The pin 84 is provided with a recess 90 at its end confronting the electrode 60, and an electrically conducting spiral spring 92 extends between the recess 90 in the pin 84 and a recess 94 in the confronting surface of the electrode 60. Electrical contact to the electrode is thus made through the pin 84 to a contact in the handle 10, not shown.

A wire screen 96 extends about and is spaced from the shell 36, the wire screen being generally cup shaped and mounted on a circular flange 98 extending from the cylindrical casing head portion 12. A layer of open cellular foam plastic 100 extends across the opening 42 in the end of the shell 36, and a layer of cloth 102 is disposed between the open cellular foam plastic layer 100 and the diaphragm 66. The open cellular foam plastic layer 100 and the cloth layer 102 not only prevent dirt and contamination from reaching the diaphragm 60, but damp the diaphragm to achieve a relatively flat frequency response to high end of the frequency response range. The diaphragm damping is desirable and necessary to provide a uniform output over the frequency range of the microphone. In addition, the acoustical resistance formed by the cloth layer 102 and open cellular foam layer 100 sharply reduce the susceptibility of the microphone to wind noise.

The open cellular foam plastic layer 100 may be polyurethane foam with from 10 to 80 pores per lineal inch and a thickness of approximately 0.3 inch. The layer 100 extends to the perimeter of the wire screen 96 to permit sound waves to have ready access to the diaphragm 66. However, the inventor has found that reflections in the sound will occur if the sound is permitted to impinge upon the cylindrical outer wall of the shell 36, and accordingly, a mass of closed cellular foam plastic 104, which is impervious to the transmission of sound, is disposed within the screen 96 and the region between the plane of the opening 42 and the cylindrical casing head portion 12. The closed cellular foam functions in the manner of a sound damping mass to convert reflected sound into heat, and accordingly, the mass should be as coarse as possible. The inventor has found that a mass of foam material in which at least half of the cells are closed having between 10 and 80 cells per lineal inch is satisfactory. Further, the mass should completely cover all surfaces of the handle which could reflect sound and extend from these surfaces a distance of at least three-fourths the diameter of the diaphragm to the plane of the opening 42 in the shell 36. In order to provide an adequate depth of closed cellular material, the surface of the ring 26 tapers conically upwardly between the shoulder 22 and the shell 36. The inventor has found that with this construction, sound attenuation for sounds originating at the rear side of the diaphragm 66 will be minimized and that the microphone will function substantially in an omnidirectional manner.

Those skilled in the art will recognize advantages and uses for the inventions here set forth beyond those specifically described. It is therefore intended that the scope of the present invention be not limited by the foregoing disclosure, but rather only by the appended claims.

The invention claimed is:

1. A condenser microphone comprising a condenser unit including a hollow shell having a first end and a second end, said shell being open at the first end thereof, an electrically conducting diaphragm confronting the open first end of the shell and an electrically conducting back plate disposed on the side of the diaphragm opposite the open first end of the shell, said back plate being spaced from and electrically insulated from the diaphragm, a casing having one end with a cross section greater than the cross section of the shell, means for mounting the second end of the shell on said one end of the casing, said shell extending outwardly from said one end of the casing, and a mass of closed cellular plastic foam material disposed about the exterior surface of the shell and extending from the one end of the casing to the open end of the shell.

2. A condenser microphone comprising the combination of claim 1 wherein the shell is cylindrical and the one end of the casing is circular, the shell being mounted coaxially on the one end of the casing.

3. A condenser microphone comprising the combination of claim 1 wherein the mass of closed cellular material consists essentially of interconnected bubbles, at least one-half of said bubbles being closed, said mass containing between 10 and 80 bubbles per lineal inch.

4. A condenser microphone comprising the combination of claim 3 wherein the mass of closed cellular material extends from the first end of the shell to the casing, a distance of at least three-fourths the cross section of the shell.

5. A condenser microphone comprising the combination of claim 1 in combination with a layer of open cellular plastic foam material disposed across the open end of the shell.

6. A condenser microphone comprising the combination of claim 5 in combination with a layer of cloth disposed across the opening in the one end of the shell forming an acoustical resistance for damping the diaphragm.

7. A condenser microphone comprising the combination of claim 6 wherein the diaphragm has a maximum cross section no greater than one-half inch.

* * * * *